US009859607B2

(12) United States Patent
Hwang et al.

(10) Patent No.: US 9,859,607 B2
(45) Date of Patent: Jan. 2, 2018

(54) ANTENNA OF ELECTRONIC DEVICE

(71) Applicant: Samsung Electronics Co., Ltd., Gyeonggi-do (KR)

(72) Inventors: Soon Ho Hwang, Seoul (KR); Ui Chul Jeong, Gyeonggi-do (KR); Sung Koo Park, Gyeonggi-do (KR); Chan Kyu An, Incheon (KR); Joon Ho Byun, Gyeonggi-do (KR); Sang Keun Yoo, Gyeonggi-do (KR); Yoon Jae Lee, Gyeonggi-do (KR); Jin Woo Jung, Seoul (KR); Jae Bong Chun, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 103 days.

(21) Appl. No.: 14/829,305

(22) Filed: Aug. 18, 2015

(65) Prior Publication Data

US 2016/0049720 A1 Feb. 18, 2016

(30) Foreign Application Priority Data

Aug. 18, 2014 (KR) ..... 10-2014-0106730

(51) Int. Cl.

| | |
|---|---|
| ***H01Q 1/24*** | (2006.01) |
| ***H01Q 1/48*** | (2006.01) |
| ***H01Q 9/14*** | (2006.01) |
| ***H01Q 9/42*** | (2006.01) |

(52) U.S. Cl.

CPC ..... *H01Q 1/243* (2013.01); *H01Q 1/48* (2013.01); *H01Q 9/145* (2013.01); *H01Q 9/42* (2013.01)

(58) Field of Classification Search

CPC ..... H01Q 1/243; H01Q 1/48; H01Q 1/46; H01Q 9/0407; H01Q 9/145; H01Q 9/42; H01Q 1/38

USPC ..... 343/700 MS, 702, 829, 846; 455/575.5, 455/575.7, 575.8

See application file for complete search history.

(56) References Cited

U.S. PATENT DOCUMENTS

| | | | | |
|---|---|---|---|---|
| 5,767,810 | A * | 6/1998 | Hagiwara | H01Q 9/0421 343/700 MS |
| 7,161,548 | B2 * | 1/2007 | Tsukamoto | H01Q 13/10 343/702 |
| 7,439,917 | B2 | 10/2008 | Harano | |
| 8,466,839 | B2 | 6/2013 | Schlub et al. | |
| 8,842,048 | B2 | 9/2014 | Kim et al. | |

(Continued)

FOREIGN PATENT DOCUMENTS

| | | |
|---|---|---|
| CN | 102447165 | 5/2012 |
| EP | 1 439 603 | 7/2004 |
| JP | 2012-146822 | 8/2012 |
| KR | 10-2012-0117048 | 10/2012 |
| KR | 10-2013-0020981 | 3/2013 |

OTHER PUBLICATIONS

European Search Report dated Nov. 23, 2015 issued in counterpart application No. 15181458.9-1812, 8 pages.

(Continued)

*Primary Examiner* — Tho G Phan

(74) *Attorney, Agent, or Firm* — The Farrell Law Firm, P.C.

(57) ABSTRACT

An antenna of an electronic device is provided, which includes a radiator including at least part of a metal housing of the electronic device; a capacitor connected to the radiator; a feeding part connected to the radiator; and a ground part connected to the capacitor.

18 Claims, 12 Drawing Sheets

(56) References Cited

U.S. PATENT DOCUMENTS

| | | | | |
|---|---|---|---|---|
| 8,963,783 | B2 | 2/2015 | Vin et al. | |
| 9,059,506 | B2 | 6/2015 | Kim et al. | |
| 9,093,752 | B2 * | 7/2015 | Yarga | H01Q 5/328 |
| 9,190,712 | B2 | 11/2015 | Hu et al. | |
| 9,559,425 | B2 * | 1/2017 | Zhu | H01Q 13/10 |
| 2004/0263394 | A1 | 12/2004 | Harano | |
| 2011/0012794 | A1 | 1/2011 | Schlub et al. | |
| 2012/0009983 | A1 | 1/2012 | Mow et al. | |
| 2012/0262345 | A1 | 10/2012 | Kim et al. | |
| 2013/0044032 | A1 | 2/2013 | Wu | |
| 2013/0050026 | A1 | 2/2013 | Vin et al. | |
| 2013/0201067 | A1 | 8/2013 | Hu et al. | |
| 2014/0111388 | A1 | 4/2014 | Di Nallo et al. | |
| 2014/0139380 | A1 | 5/2014 | Ouyang et al. | |
| 2014/0147297 | A1 | 5/2014 | Iyer et al. | |
| 2014/0266922 | A1 * | 9/2014 | Jin | H01Q 21/28 343/702 |
| 2014/0354491 | A1 | 12/2014 | Kim et al. | |
| 2015/0130670 | A1 | 5/2015 | Vin et al. | |
| 2015/0280771 | A1 | 10/2015 | Mow et al. | |

OTHER PUBLICATIONS

International Search Report dated Dec. 4, 2015 issued in counterpart application No. PCT/KR2015/008624, 3 pages.
Australian Examination Report dated Nov. 3, 2017 issued in counterpart application No. 2015304148, 3 pages.

* cited by examiner

ANTENNA OF ELECTRONIC DEVICE

PRIORITY

This application claims priority under 35 U.S.C. §119(a) to Korean Patent Application Serial No. 10-2014-0106730, which was filed in the Korean Intellectual Property Office on Aug. 18, 2014, the entire disclosure of which is hereby incorporated by reference.

BACKGROUND

1. Field of the Invention

The present disclosure relates to an antenna including a capacitance component.

2. Description of the Related Art

An antenna is an electrical device that converts electric power into radio frequency (RF) waves, and vice versa. An antenna is usually used with an RF transmitter or receiver.

Recently, antenna technology has been developed, which uses a metal case of an electronic device as part of an antenna.

SUMMARY

An aspect of the present disclosure is to provide an antenna including a capacitance component.

In accordance with an aspect of the present disclosure, an antenna of an electronic device is provided, which includes a radiator including at least part of a metal housing of the electronic device; a capacitor connected to the radiator; a feeding part connected to the radiator; and a ground part connected to the capacitor.

In accordance with another aspect of the present disclosure, an antenna of an electronic device is provided, which includes a radiator including at least part of a metal housing of the electronic device; a feeding part connected to the radiator; a direct current (DC) blocking member spaced apart from the radiator; and a ground part connected to the DC blocking member.

In accordance with another aspect of the present disclosure, an antenna of an electronic device is provided, which includes a radiator including at least part of a metal housing of the electronic device; a feeding part connected to the radiator; and a ground part connected to a capacitor. At least part of the metal housing is used as a first conductor of the capacitor and a conductive material connected to the ground part is used as a second conductor of the capacitor.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION OF EMBODIMENTS OF THE DISCLOSURE

Figure 1:
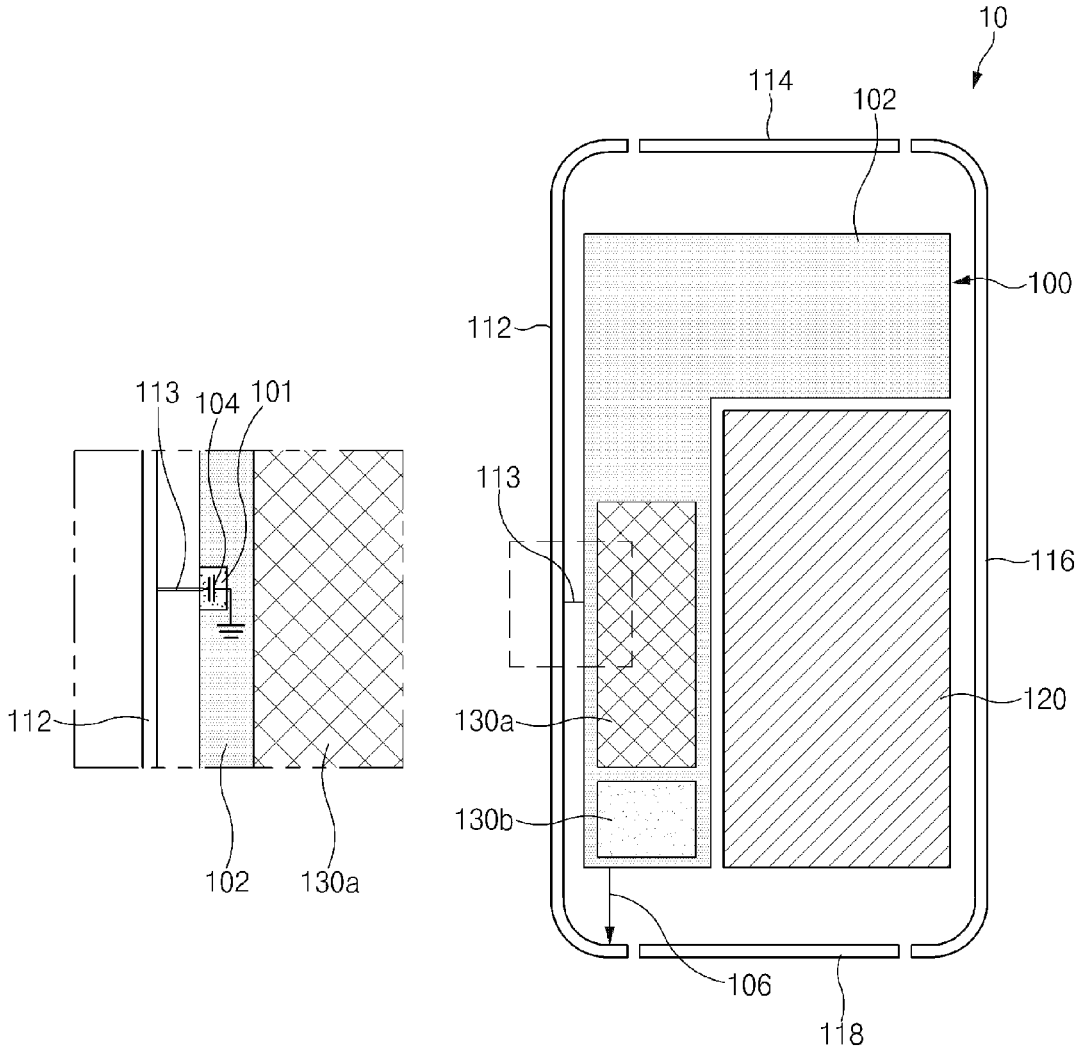
FIG. 1 illustrates an electronic device including an antenna using a lumped element of a capacitance component according to an embodiment of the present disclosure.

Hereinafter, various embodiments of the present disclosure are described in detail with reference to the accompanying drawings. However, this description is not intended to limit the present disclosure to the described embodiments and it should be understood that the present disclosure covers all the modifications, equivalents, and/or alternatives of this disclosure as defined within the scope of the appended claims and their equivalents.

With respect to the descriptions of the drawings, like reference numerals in the drawings refer to like elements.

Herein, the terms "include," "comprise," "have", "may include," "may comprise", and "may have" indicate disclosed functions, operations, or existence of elements, but do not exclude other functions, operations, or elements.

Further, the expression "A or B" or "at least one of A or/and B" may indicate A or B, or both A and B.

Herein, terms such as "1st", "2nd", "first", "second", etc., are used to indicate different elements included in various embodiments of the present disclosure, but do not limit the elements. That is, these expressions may be used to distinguish one element from another element. For example, "a first user device" and "a second user device" may indicate different user devices, regardless of the order or the importance. Additionally, a first component may be referred to as a second component and vice versa, without departing from the scope of the present disclosure.

Further, when a component (for example, a first component) is referred to as being "operatively or communicatively coupled with/to" or "connected to" another component (for example, a second component), the component can be directly connected to the other component or connected through another component (for example, a third component). Additionally, when a component (for example, a first component) is referred to as being "directly connected to" or "directly accessed by" another component (for example, a second component), another component (for example, a third component) does not exist between the first component and the second component.

Herein, the expression "configured to" may be interchangeably used with "suitable for", "having the capacity to", "designed to", "adapted to", "made to", or "capable of" according to the context. The term "configured to" may not necessarily mean "specifically designed to" in terms of hardware. Instead, the expression "a device configured to" in some situations may mean that the device and another device or part are "capable of" a certain feature. For example, "a processor configured to perform A, B, and C" may mean a dedicated processor (for example, an embedded processor) for performing a corresponding operation or a generic-purpose processor (for example, a central processing unit (CPU) or application processor) for performing corresponding operations by executing at least one software program stored in a memory device.

The terms of a singular form may include plural forms unless they have a clearly different meaning in the context.

Unless otherwise indicated herein, all the terms used herein, which include technical or scientific terms, may have the same meanings that are generally understood by a person skilled in the art. In general, the terms defined in a general dictionary should be considered to have the same meaning as the dictionary definition in the related art, and, unless clearly defined herein, should not be understood abnormally or as having an excessively formal meaning. In any case, even the terms defined in this specification cannot be interpreted as excluding embodiments of the present disclosure.

Examples of electronic devices described herein may include smartphones, tablet personal computers (PCs), mobile phones, video phones, electronic book (e-book) readers, desktop personal computers (PCs), laptop PCs, netbook computers, workstation server, personal digital assistants (PDAs), portable multimedia player (PMPs), MP3 players, mobile medical devices, cameras, and wearable devices (for example, smart glasses, head-mounted-devices (HMDs), electronic apparel, electronic bracelets, electronic necklaces, electronic appcessories, electronic tattoos, smart mirrors, and smart watches).

Examples of the electronic devices may also include smart home appliances, for example, televisions (TVs), digital video disk (DVD) players, audio players, refrigerators, air conditioners, cleaners, ovens, microwave ovens, washing machines, air cleaners, set-top boxes, home automation control panels, security control panels, TV boxes (e.g., Samsung HomeSync®, Apple TV®, or Google TV®), game consoles (for example, Xbox® and PlayStation®), electronic dictionaries, electronic keys, camcorders, and electronic picture frames.

Additionally, an electronic device may be a flexible electronic device using a capacitor as part of an antenna.

However, an electronic device herein is not limited to the above-described devices and may include a new kind of electronic device according to the technology development.

Herein, the term "user" may refer to a person using an electronic device or a device using an electronic device (for example, an artificial intelligence electronic device).

In relation to an electronic device with a metal housing, since the metal is exposed to the outside, electric shock may be an issue always while the electronic device is charged. The electric shock issue may be prevented through post processing such as plating, coating, and oxidation treatment on the metal housing. However, when a predetermined time elapses or due to careless consumers or distribution issues, a protective layer formed through post processing may be cracked or fall off. In this case, electric shock issue may occur again.

In the current of a DC component, a capacitor may operate as an open circuit. That is, the capacitor may prevent the flow of a DC component. Accordingly, when a capacitance component is connected between the metal housing and the ground part, even if an electronic device is in charging, DC current will not flow into a user gripping the electronic device through the metal housing, and the electric shock issue may be prevented.

FIG. 1 illustrates an antenna using a lumped element with a capacitance component as a capacitor according to an embodiment of the present disclosure. Specifically, the antenna in FIG. 1 uses a lumped element 104 as a capacitor for blocking DC current. The right side of FIG. 1 illustrates an electronic device 10 and the left of FIG. 1 is an enlarged view of a dotted area in the right side of the drawing.

Referring to FIG. 1, the electronic device 10 includes a PCB 100, a first metal housing 112, a second metal housing 114, a third metal housing 116, a fourth metal housing 118, a battery 120, and components 130*a* and 130*b*, which are mounted on the PCB 100.

The PCB 100 includes a ground part 102 and a feeding part 106.

Although FIG. 1 illustrates the PCB 100 having a 'Γ' form (being L shaped) and being disposed parallel to the battery 120, the PCB 100 may also have a '▭' form (have a rectangular shape), wherein the PCB 100 is stacked on the battery 120 and vice versa.

The battery 120 supplies power to the electronic device 10. Specifically, as an antenna receives power through the feeding part 106, the electronic device 10 may use the antenna.

The components 130*a* and 130*b* may be processors, communication processors (CPs), speakers, etc.

Although FIG. 1 illustrates two components 130*a* and 130*b* being mounted on the PCB 100, the number of components mounted on the PCB 100 may vary, for example, may be one or three or more.

The antenna of the electronic device 10 includes the ground part 102, the lumped element 104, the feeding part 106, and a radiator. The radiator may include at least part of the first metal housing 112. For example, although the entire first metal housing 112 may operate as a radiator, in different designs only part of the first metal housing 112 may operate as a radiator.

An antenna may have a length appropriate for a frequency to be used. Therefore, the part of the first metal housing 112 that will operate as the radiator of the antenna can be configured based on a frequency that the electronic device 10 is to use.

The antenna further includes a connection part 113 connecting the first metal housing 112 and the lumped element 104. The connection part 113 may be a conductive material.

For example, the antenna may be a planar inverted F antenna (PIFA) and current flowing from the feeding part 106 flows into the radiator and part of the current flows into the ground part 102 through the connection part 113 and the lumped element 104, thereby operating the antenna. However, because current of a DC component cannot flow through the lumped element 104, current flowing into the ground part 102 through the lumped element 104 may be limited to an AC component. According to an embodiment of the present disclosure, the connection part 113 may be part of the metal housing 112.

Referring to the left drawing of FIG. 1, the PCB 100 further includes a non-ground area 101, in additional to the ground part 102 (for example, a ground area). The non-ground area 101 is not conductive and may be a fill cut area, for example. If the lumped element 104 is disposed on the ground part 102, instead of the non-ground area 101, the connection part 113 may be connected to one conductor of the lumped element 104 and the ground part 102 simultaneously. In this case, because a user gripping the electronic device 10 can be electrically shocked, the lumped element 104 should be disposed on the non-ground area 101.

Basically, a capacitor includes two conductors separated through a non conductive area (for example, a dielectric material). The two conductors may have a plate or pad form.

According to an embodiment of the present disclosure, the lumped element 104 includes two conductors, but only one of the two conductors may be connected to the ground part 102. For example, as illustrated in FIG. 1, the lumped element 104 is not disposed on the PCB 100, but is disposed between the first metal housing 112 and the PCB 100, so that the first conductor of the lumped element 104 is connected to the connection part 113 and the second conductor is connected to the ground part 102. Because the first conductor and the second conductor are separated from each other, the connection part 113 or the first conductor may be designed to not contact the ground part 102, and in this case, an additional non-ground area 101 may not be required.

Although FIG. 1 illustrates at least part of the first metal housing 112 operates as a radiator, part of a metal back housing or a metal battery case of the electronic device 10 may also be used as a radiator.

Alternatively, in addition to the first metal housing 112, the second metal housing 114, the third metal housing 116, and/or the fourth metal housing 118 may operate as the radiator.

As described above, the electronic device 10 may be a flexible electronic device, and in this case, the PCB 100 may be an FPCB.

Figure 2:
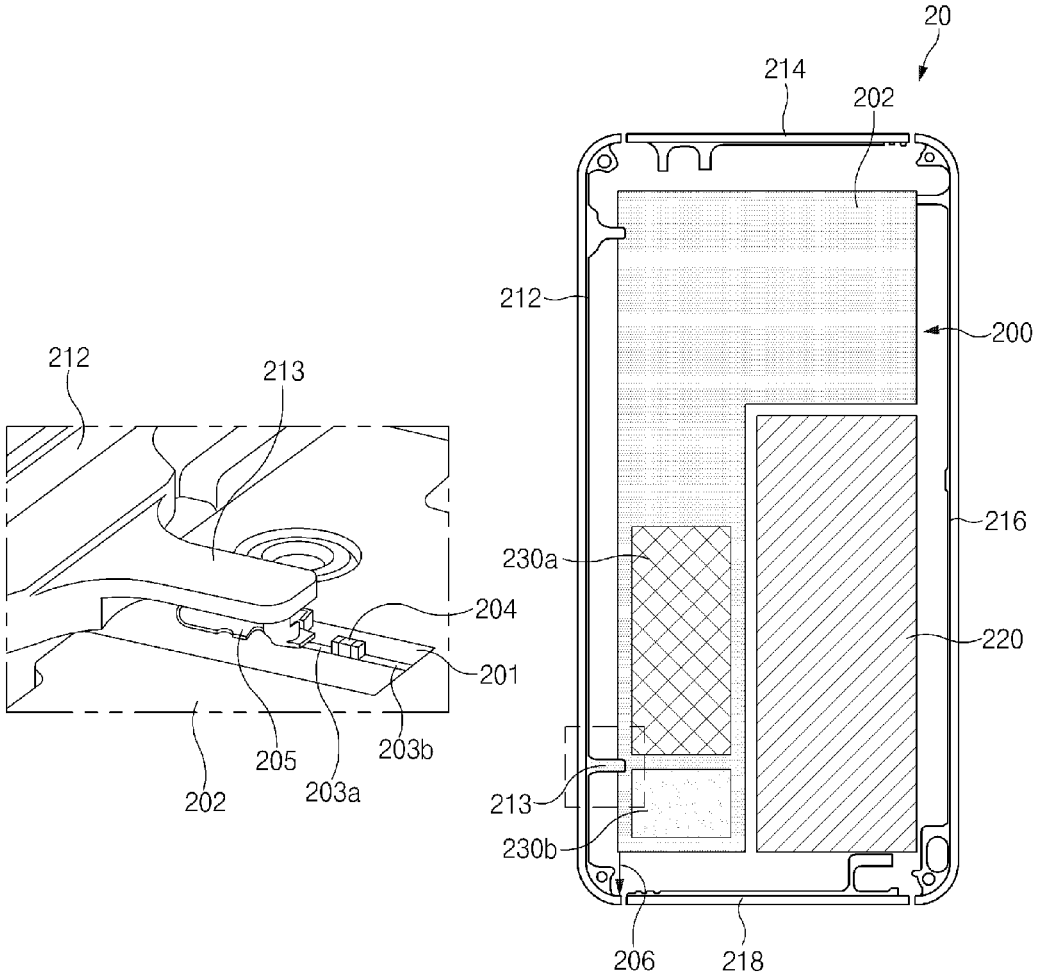
FIG. 2 illustrates an electronic device including an antenna using a lumped element of a capacitance component according to another embodiment of the present disclosure.

FIG. 2 illustrates an electronic device including an antenna using a lumped element of a capacitance component as a capacitor according to an embodiment of the present disclosure. Specifically, the right side of FIG. 2 illustrates an electronic device 20 and the left side of FIG. 2 is an enlarged view of a dotted area in the right side of the drawing.

Referring to FIG. 2, the electronic device 20 includes a PCB 200, a first housing 212, a second housing 214, a third housing 216, a fourth housing 218, and a battery 220, and components 230*a* and 230*b*. Additionally, an antenna of the electronic device 20 includes a ground part 202, a lumped element 204, a feeding part 206, at least part of the first housing 212, and a connection part 213. The elements of the electronic device 20 of FIG. 2, which are outside of the dotted area, correspond to the same elements in the electronic device 10 of FIG. 1; thus, repetitive descriptions of these elements are omitted.

The connection part 213 extends from the first metal housing 212. The connection part 213 is also fixed on the PCB 200 through a fixing part 205. For example, the fixing part 205 may include a c-clip. The fixing part 205 is formed of a conductive material and is connected to a first conductor of the lumped element 204 through a leading wire 203*a*. Additionally, the second conductor of the lumped element 204 is connected to the ground part 202 through a leading wire 203*b*.

The leading wire 203*a* and the leading wire 203*b* are separated from each other by the lumped element 204. If the leading wire 203*a* and the leading wire 203*b* were connected to each other, the first metal housing 212, the connection part 213, and the fixing part 205 would be connected to the ground part 202, which cannot solve electric shock issue.

Additionally, a non-ground area 201 prevents each of the first metal housing 212, the connection part 213, and the fixing part 205 from being connected to the ground part 202.

The feeding part 206 supplies power to the antenna. Specifically, current flowing through the feeding part 206 flows into the first mental housing 212 and part of the current flows into the ground part 202 through the connection part 213, the fixing part 205, the leading wire 203*a*, the lumped element 204, and the leading wire 203*b*. The flowing current may not include a DC component, only an AC component. Thus, the antenna of the electronic device 20 further includes the fixing part 205, the leading wire 203*a*, and the leading wire 203*b*.

As described above, in addition to using at least part of the first metal housing 212 as the radiator, at least part of a metal back housing and the first metal housing 212 may operate as the radiator by electrically connecting the two.

Figure 3:
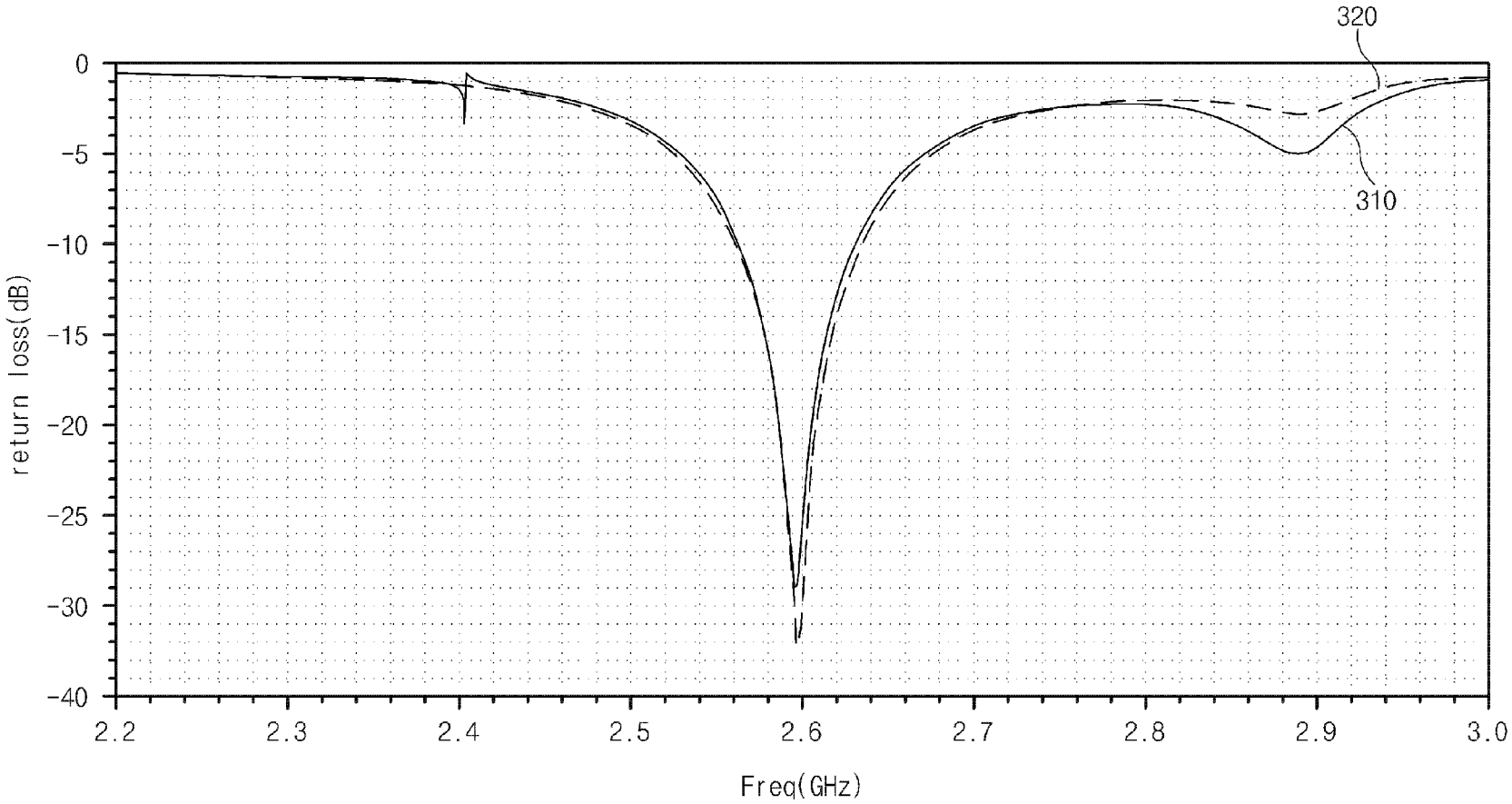
FIG. 3 is a graph illustrating antenna characteristics according to an embodiment of the present disclosure.

FIG. 3 is a graph illustrating antenna characteristics according to an embodiment of the present disclosure.

Referring to FIG. 3, the x-axis of the graph represents frequency and the y-axis of the graph represents return loss.

A first waveform 310 represents the characteristic of an antenna using a capacitance component and a second waveform 320 represents the characteristic of an antenna not using a capacitance component. Comparing the first waveform 310 and the second waveform 320, the operating frequencies and bandwidths are similar to each other with only a slight difference. Accordingly, as illustrated in FIG. 3, the antenna using the capacitance component does not have noticeable performance deterioration.

Although the characteristic graph in FIG. 3 illustrates that the antennas operate in a high frequency of about 2.6 GHz, the antennas may operate similar to this in a low frequency of less than 2 GHz.

Figure 4:
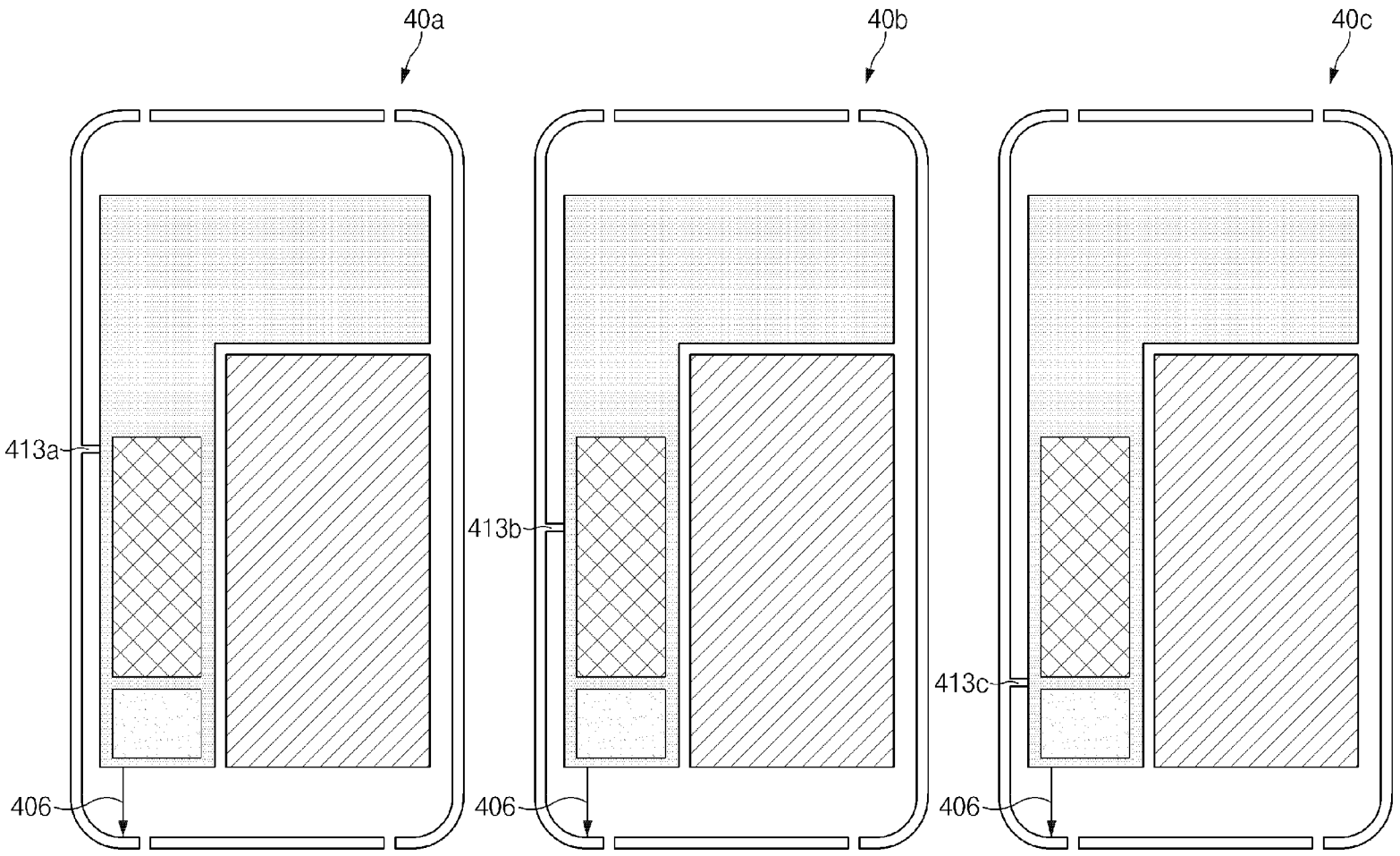
FIG. 4 illustrates electronic devices according to various embodiments of the present disclosure.

FIG. 4 illustrates electronic devices according to various embodiments of the present disclosure.

Figure 5:
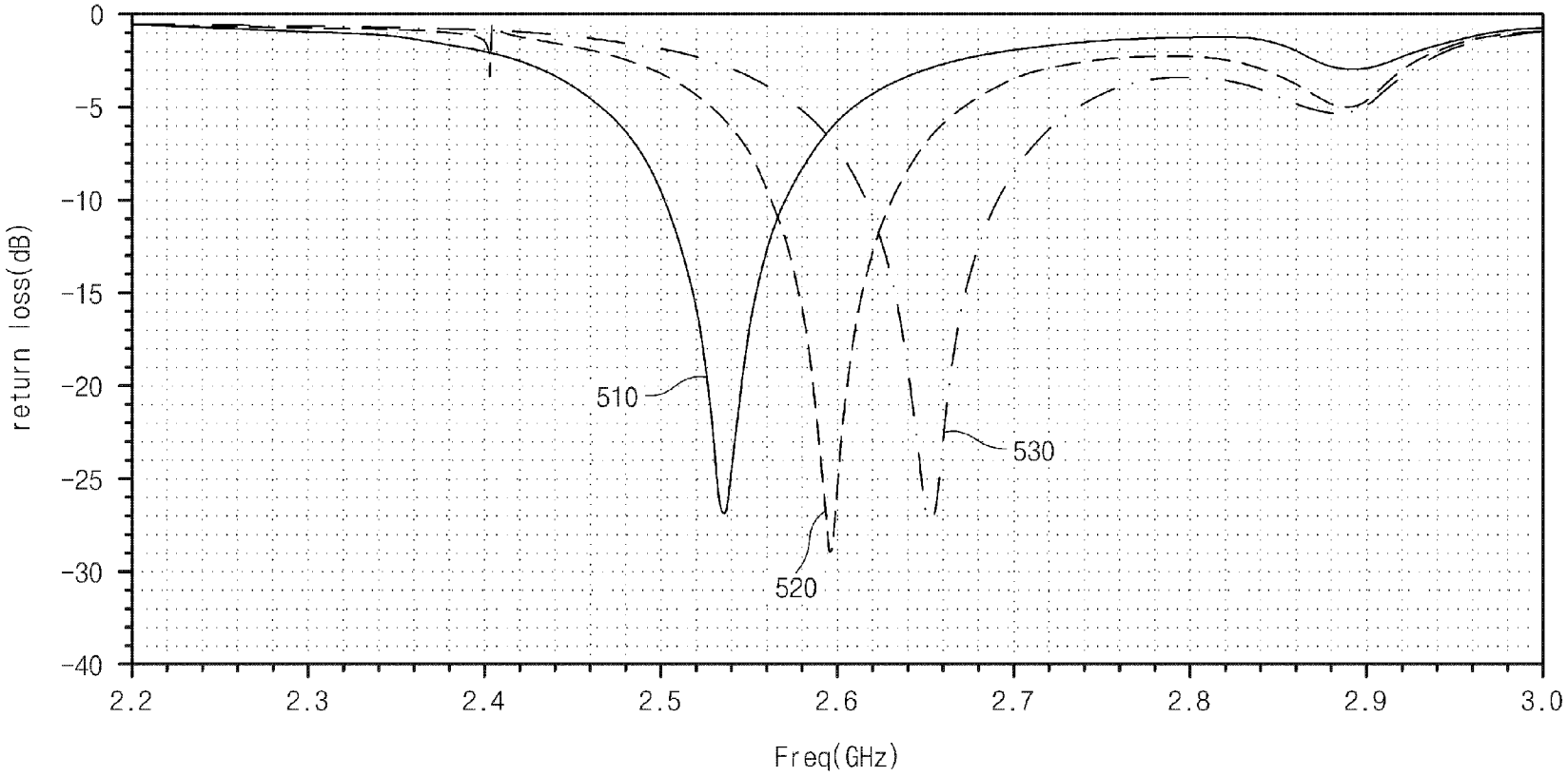
FIG. 5 is a graph illustrating antenna characteristics according to various embodiments of the present disclosure.

FIG. 5 is a graph illustrating antenna characteristics according to various embodiments of the present disclosure.

As described above, an antenna may be designed to use different frequency bands according to the length of a form or a radiator. Accordingly, referring to FIGS. 4 and 5, different frequency bands are used, according to the length of a radiator.

Referring to FIG. 4, each of electronic devices 40*a*, 40*b*, and 40*c* may correspond to the electronic device 10 illustrated in FIG. 1, except for the position of connection parts 413*a*, 413*b*, and 413*c*.

Specifically, the electronic device 40*a* includes a connection part 413*a* at a relatively high position as compared to the electronic devices 40*b* and 40*c*. Additionally, the electronic device 40*b* includes the connection part 413*b* at a relatively lower position than the electronic device 40*a*, and the electronic device 40*c* includes the connection part 413*c* at a relatively lower position than the electronic device 40*b*.

Because the radiator of the antenna starts from a feeding part 406 and ends at the connection parts 413*a*, 413*b*, and 413*c*, the radiator length of the antenna of the electronic device 40*a* is the longest and the radiator length of the antenna of the electronic device 40*c* is the shortest. However, it is assumed that a capacitance component element used in the antenna of each of the electronic devices 40*a*, 40*b*, and 40*c* is connected to a ground part at a position on a PCB to which each of the electronic devices 40*a*, 40*b*, and 40*c* is connected.

Referring to waveforms 510, 520, and 530 in FIG. 5, the waveform 510 has an operating frequency in the lowest frequency band and the waveform 530 has an operating frequency in the highest frequency band. Additionally, an operating frequency of the waveform 520 is higher than the operating frequency of the waveform 510 and is lower than the operating frequency of the waveform 530.

Since the length of a radiator and an operating frequency are inversely proportional to each other, the waveform 510 may relate to the antenna of the electronic device 40*a*, which has the longest radiator length; the waveform 520 may relate to the antenna of the electronic device 40*b*; and the waveform 530 may relate to the antenna of the electronic device 40*c*, which has the shortest radiator length.

As illustrated in FIG. 5, although the operating frequencies are different, there is no great difference in bandwidth and return loss. Accordingly, a connection part of an antenna may freely be disposed at a position based on an operating frequency of the antenna. For example, because different countries use different communication frequencies, an electronic device for use in a corresponding country may be designed such that the placement of a connection part of an antenna is based on the communication frequency of that country.

Additionally, even after an electronic device is manufactured, frequency tuning may be accomplished simply by changing the position of the connection part.

Figure 6:
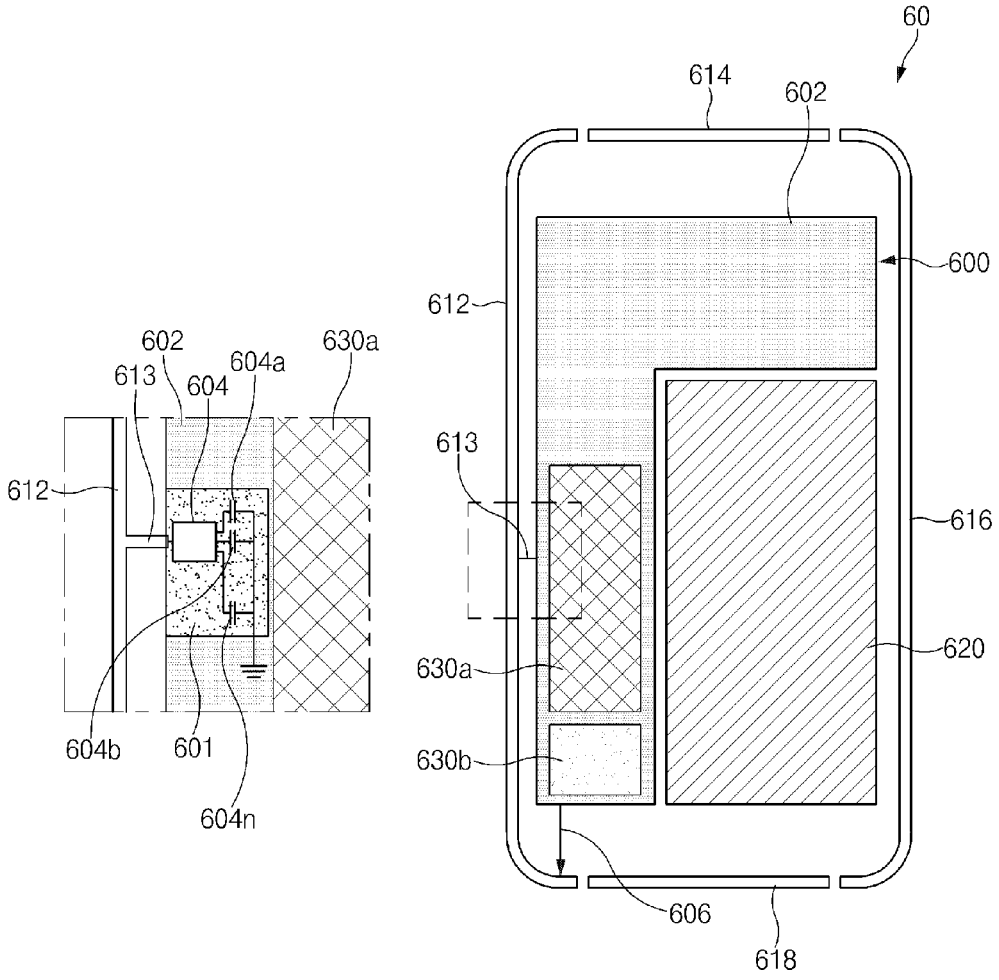
FIG. 6 illustrates an electronic device including an antenna using at least one of a plurality of lumped elements of a capacitance component through a controller according to an embodiment of the present disclosure.

FIG. 6 illustrates an electronic device including an antenna using at least one of a plurality of lumped elements of a capacitance component according to an embodiment of the present disclosure. The elements of the electronic device 60 of FIG. 6, which are outside of the dotted area, correspond to the same elements in the electronic device 10 of FIG. 1; thus, repetitive descriptions of these elements are omitted. Further, a non-ground area 601 of FIG. 6 corresponds to the non-ground area 101 in the electronic device 10 of FIG. 1; thus, a repetitive description of this element is omitted.

Referring to FIG. 6, an antenna of the electronic device 60 includes a plurality of lumped elements 604*a*, 604*b*, . . . 604*n*. Additionally, the antenna includes a controller 604 for controlling the current flowing into each of the plurality of lumped elements 604*a*, 604*b*, . . . 604*n*. For example, the controller 604 may include a switch for selecting one of the plurality of lumped elements 604*a*, 604*b*, . . . 604*n*, or may include a switch for each of the plurality of lumped elements 604*a*, 604*b*, . . . 604*n*.

For example, when the antenna operates in a first operating frequency, if the first lumped element 604*a* and the second lumped element 604*b* should be used, the controller 604 may close the switches for the first lumped element 604*a* and the second lumped element 604*b*, and may open the switch for the remaining lumped elements. In this case, the antenna may operate in the first operating frequency based on a composite capacitance value of the first lumped element 604*a* and the second lumped element 604*b*.

Additionally, when the antenna operates in a second operating frequency, if the first lumped element 604*a* and the nth lumped element 604*n* should be used, the controller 604 closes the switches for the first lumped element 604*a* and the nth lumped element 604*n* and opens the switch for the remaining lumped elements. In this case, the antenna may operate in the second operating frequency based on a composite capacitance value of the first lumped element 604*a* and the nth lumped element 604*n*.

The controller 604 may receive a signal for controlling the current flowing into each of the plurality of lumped elements 604*a*, 604*b*, . . . 604*n* and may control the current based on the received signal. For example, the signal may be received from a processor of the electronic device 60.

The controller 604 may also receive information on an operating frequency that the antenna is to use from a CP module. In this case, the controller 604 may determine at least one lumped element to be used, in order for the antenna to operate in the received operating frequency. Thereafter, the controller 604 allows the current to flow into the determined at least one lumped element.

Figure 7:
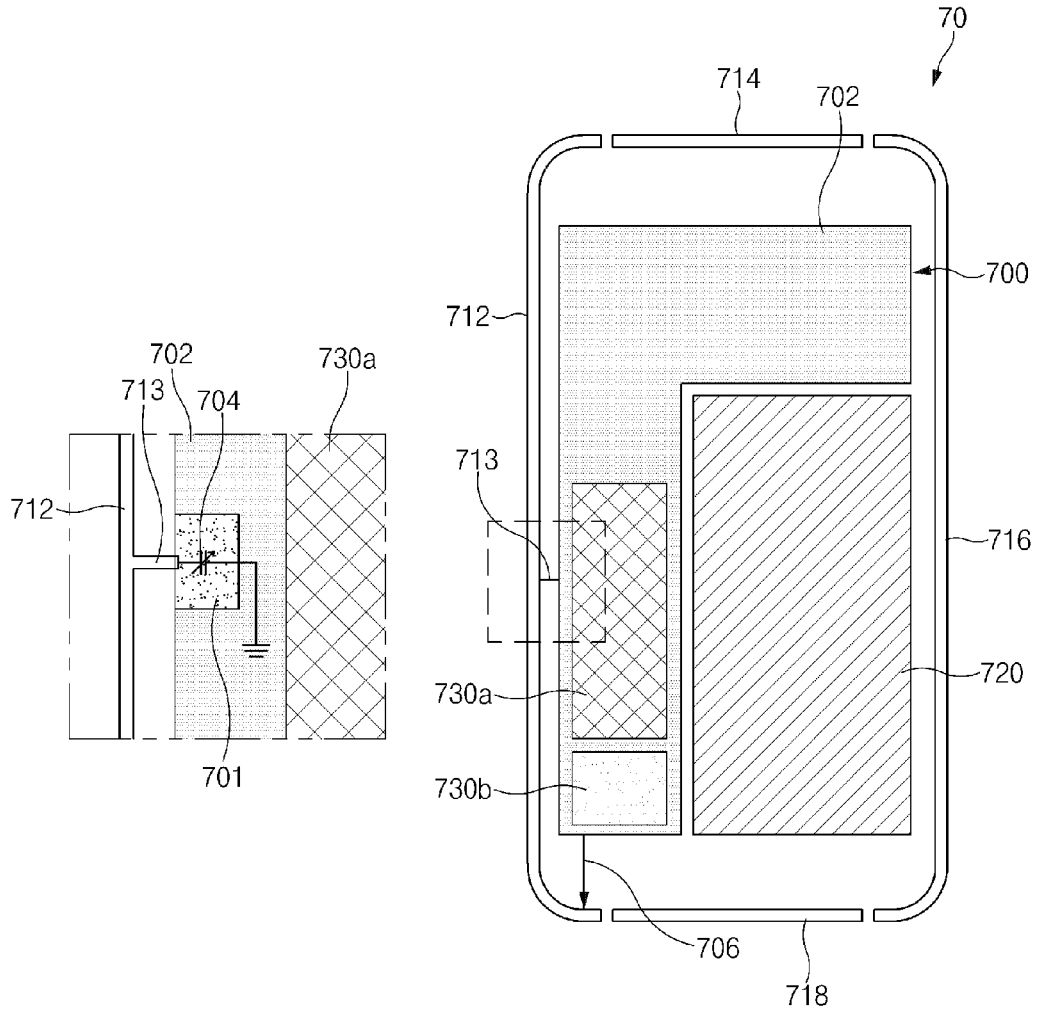
FIG. 7 illustrates an electronic device including an antenna using a variable lumped element of a capacitance component according to an embodiment of the present disclosure.

FIG. 7 illustrates an electronic device including an antenna using a variable lumped element of a capacitance component as a capacitor according to an embodiment of the present disclosure. The elements of the electronic device 70 of FIG. 7, which are outside of the dotted area, correspond to the same elements in the electronic device 10 of FIG. 1; thus, repetitive descriptions of these elements are omitted. Further, a non-ground area 701 of FIG. 7 corresponds to the non-ground area 101 in the electronic device 10 of FIG. 1; thus, a repetitive description of this element is omitted.

Referring to FIG. 7, an antenna of the electronic device 70 includes a variable lumped element 704. The variable lumped element 704 can change a capacitance value. Although not illustrated, the antenna may further include a controller for changing the capacitance value of the variable lumped element 704.

Similar to FIG. 6, the variable lumped element 704 or a controller may receive a signal for changing the capacitance value from a processor or a CP module, and may process the signal.

Figure 8:
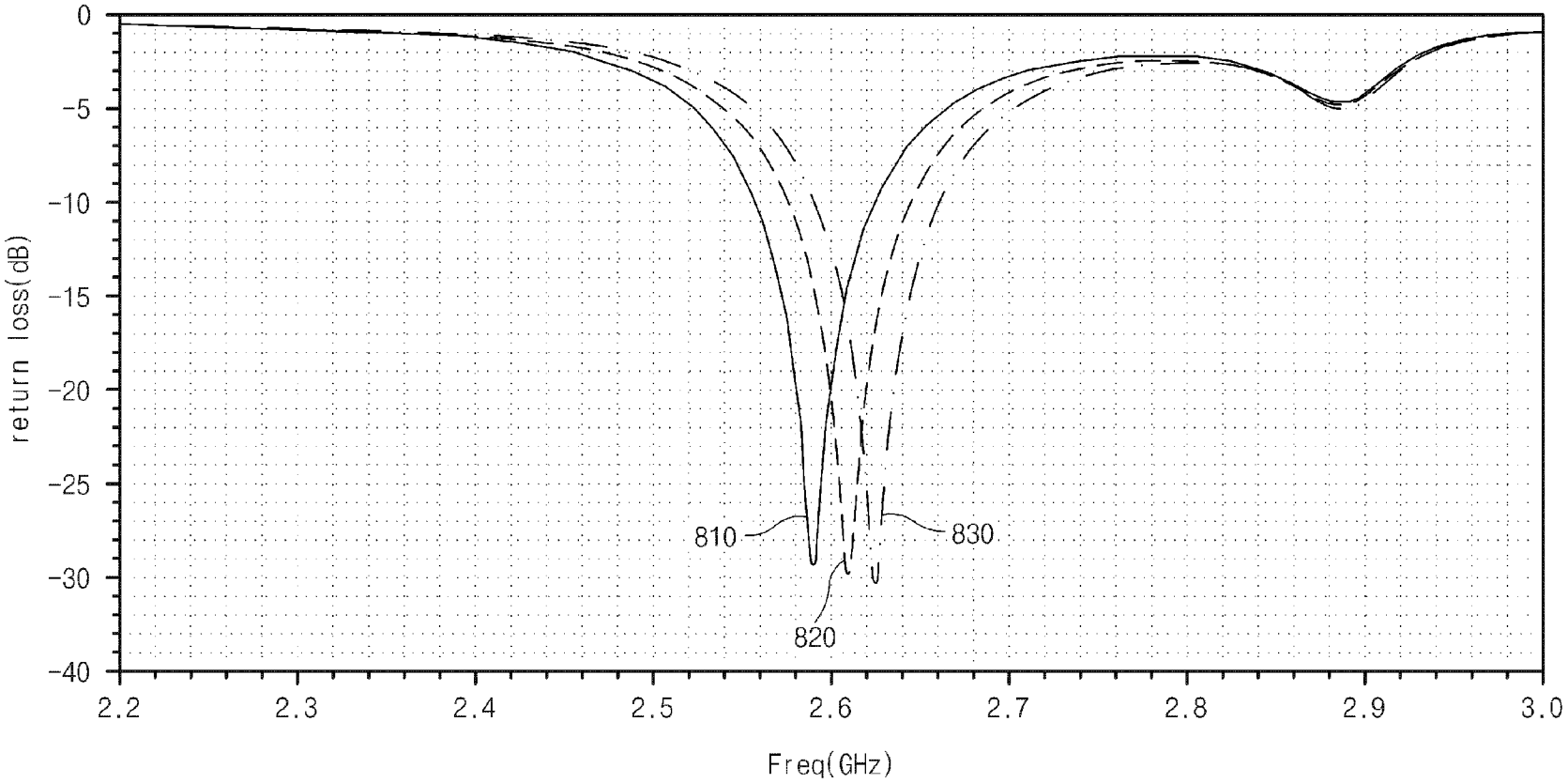
FIG. 8 is a graph illustrating antenna characteristics according to various embodiments of the present disclosure.

FIG. 8 is a graph illustrating antenna characteristics according to an embodiment of the present disclosure. Specifically, FIG. 8 illustrates different antenna characteristics for three different antennas with different capacitance values.

Because a capacitance value and an operating frequency are inversely proportional to each other, as the capacitance value decreases, an operating frequency increases, and as the capacitance value increases, an operating frequency decreases.

Referring to FIG. 8, a waveform 810 is an antenna characteristic for an antenna including a capacitor having a highest capacitance value, a waveform 820 is an antenna characteristic for an antenna including a capacitor having a lower capacitance value than the antenna corresponding to the waveform 810, and a waveform 830 is an antenna characteristic for an antenna including a capacitor having a lower capacitance value than the antenna corresponding to the waveform 820.

In comparison of the waveforms 810, 820, and 830, even though the operating frequencies are different, there is no great difference in bandwidth and return loss. Accordingly, an antenna may be freely designed to include a capacitor having a capacitance value based on an operating frequency of the antenna.

In comparison to the graph of FIG. 5, as illustrated in FIG. 8, an operating frequency may be adjusted with a fine level by varying a capacitance value. Accordingly, at the antenna design stage of an electronic device, if a communication frequency can be adjusted for each country by varying the position of a connection part, a fine frequency tuning is still possible by simply changing a capacitance value, after the electronic device is manufactured.

Because the electronic device 10 or 20, as illustrated in FIG. 1 or 2, includes a capacitor having a fixed capacitance value as part of an antenna, in order for a fine frequency tuning, the capacitor may be replaced with a capacitor having another capacitance value. Alternatively, the electronic device 10 or 20 may perform frequency turning by connecting the capacitor to another capacitor in series or parallel.

As described above, the electronic device 60 illustrated in FIG. 6 may perform frequency tuning by selecting a lumped element among a plurality of lumped elements 604*a*, 604*b*, . . . 604*n*, and the electronic device 70 illustrated in FIG. 7 may perform frequency tuning by changing a capacitance value of a variable lumped element 704.

According to an embodiment of the present disclosure, an antenna is not limited to using a formal capacitor such as a lumped element, but may also use a capacitor implemented with two conductors, separated on an electronic device, as a capacitance component.

Figure 9:
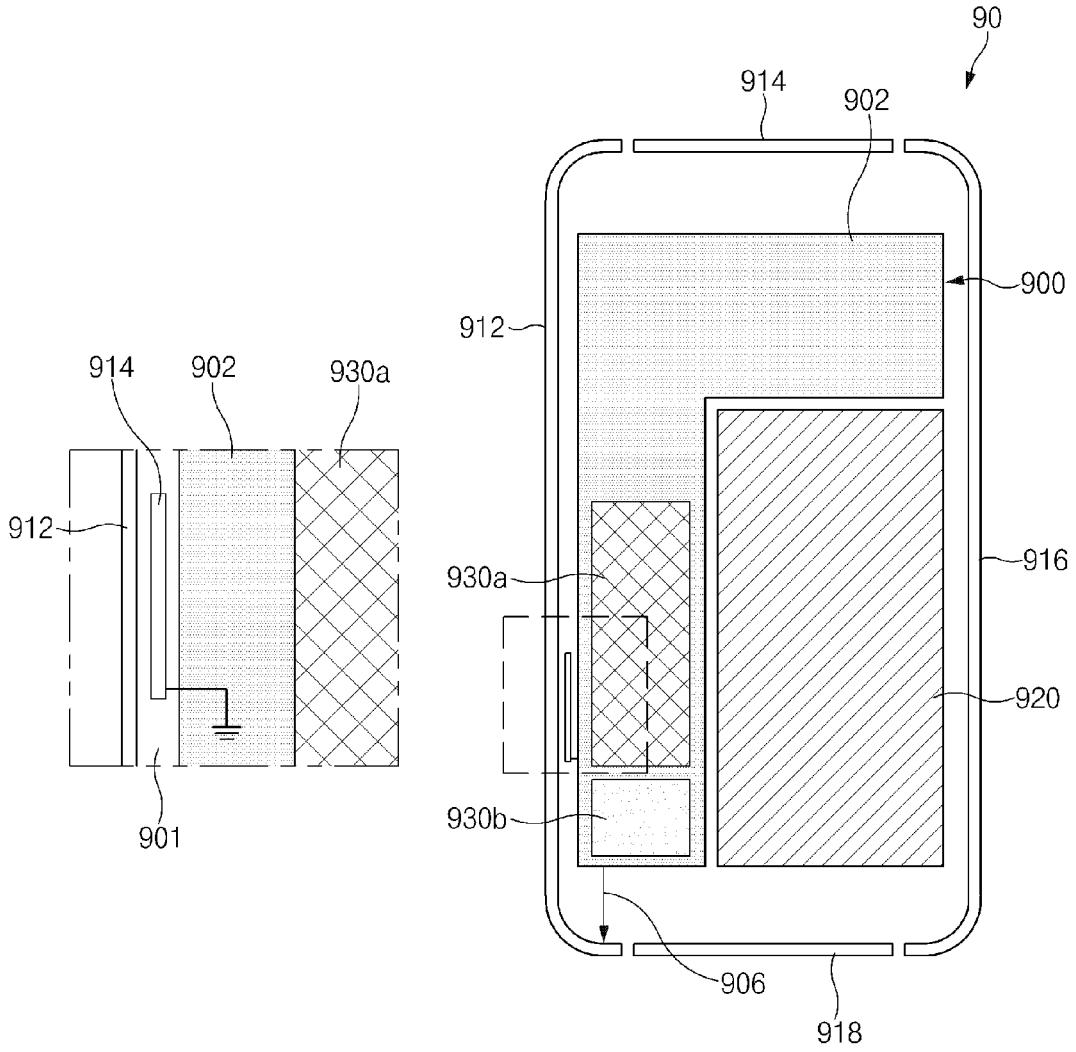
FIG. 9 illustrates an electronic device including an antenna using at least part of a metal housing and a conductive material connected to a ground part as a capacitance component according to an embodiment of the present disclosure.

FIG. 9 illustrates an electronic device including an antenna according to an embodiment of the present disclosure. The elements of the electronic device 90 of FIG. 9, which are outside of the dotted area, correspond to the same elements in the electronic device 10 of FIG. 1; thus, repetitive descriptions of these elements are omitted.

Referring to FIG. 9, the electronic device 90 includes a conductor 914 as part of an antenna. For example, the conductor 914 has a flat plate form corresponding (in parallel) to the first metal housing 912. Accordingly, the first metal housing 912 and the conductor 914 respectively operate as a first conductor and a second conductor of a capacitor. In this case, an area 901 is non-conductive in order for the capacitor to operate. Although FIG. 9 illustrates the area 901 as an air layer, the present disclosure is not limited thereto and the area 901 may be filled with a non-conductive material.

The capacitor may include a parallel plate capacitor, a cylindrical capacitor, and a spherical capacitor. Therefore, according to various embodiments of the present disclosure, the form of the conductor 914 may include a curved form, a stepped form, or a saw-tooth form, in addition to a parallel plate form. The form of the conductor 914 may be designed in various forms for optimizing frequency characteristics.

Unlike the previously described antennas, because the conductor 914 does not contact the first metal housing 912 directly, a non-ground area in an area where the conductor 914 is connected on the ground part 902 may not be required.

The capacitor may change its capacitance value by changing the length of the conductor 914, the area of plate, or an interval to the first metal housing 912. Accordingly, at a manufacturing stage of the electronic device 90, the capacitor may have a desired capacitance value in consideration of these factors. Additionally, even after the electronic device 90 is manufactured, frequency tuning may be accomplished simply by connecting a capacitor with the changed factors.

Although FIG. 9 illustrates the conductor 914 and the PCB 900 being spaced apart from each other, alternatively, the conductor 914 may directly contact one side of the PCB 900.

Figure 10:
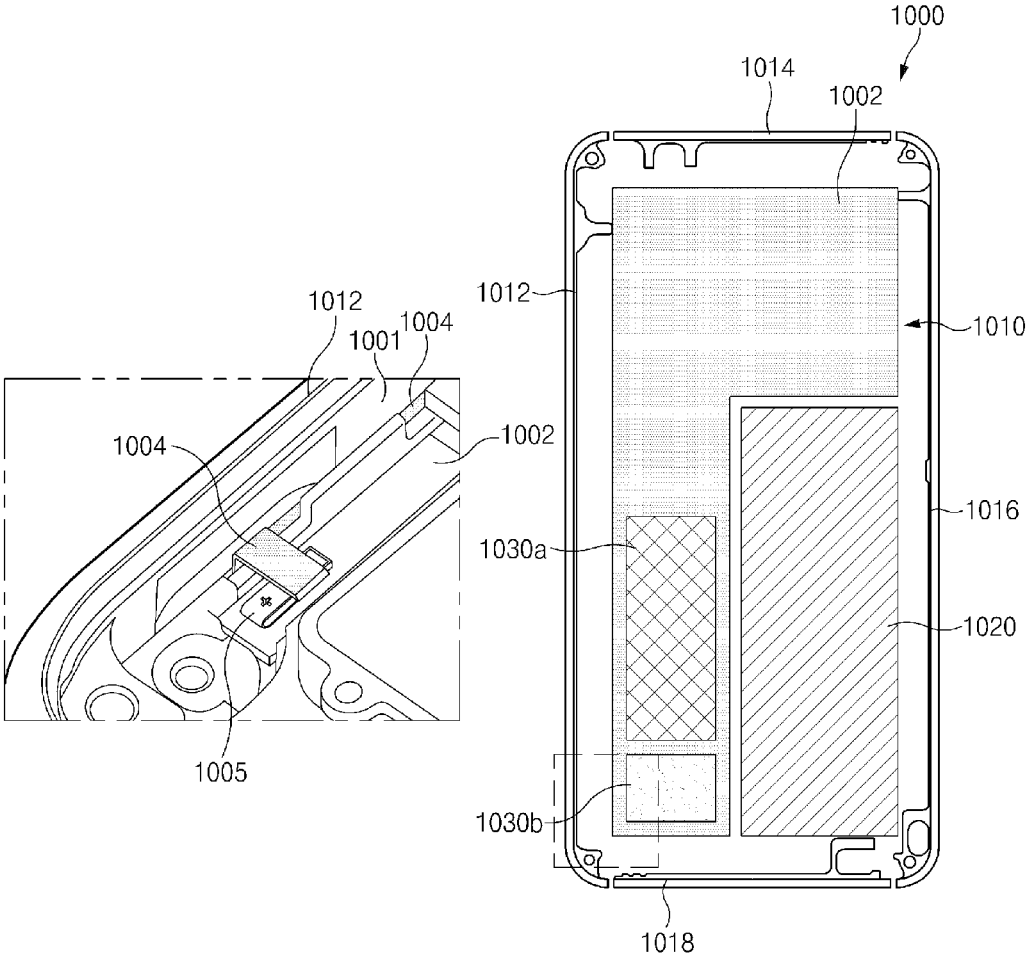
FIG. 10 illustrates an electronic device including an antenna using at least part of a metal housing and a flexible printed circuit board (FPCB) connected to a ground part as a capacitance component according to an embodiment of the present disclosure.

FIG. 10 illustrates an electronic device including an antenna according to an embodiment of the present disclosure. The elements of the electronic device 1000 of FIG. 10, which are outside of the dotted area, correspond to the same elements in the electronic device 10 of FIG. 1; thus, repetitive descriptions of these elements are omitted.

Referring to FIG. 10, the electronic device 1000 includes an FPCB 1004, which may control the volume or power of the electronic device 1000 or simply implement a capacitor.

Similar to FIG. 9, the first metal housing 1012 and the FPCB 1004, as part of an antenna that the electronic device 1000 uses, may serve as a first conductor and a second conductor of a capacitor, respectively. The FPCB 1004 may be connected to a ground part 1002 or may be fixed to the ground part 1002 through a fixing part 1005. For example, the fixing part 1005 may include a c-clip.

In order for the first metal housing 1012 and the FPCB 1004 to operate together as a capacitor, a non-conductive area remains between the first metal housing 1012 and the FPCB 1004.

Referring to FIG. 10, the first metal housing 1012 and the FPCB 1004 are spaced apart from each other. Alternatively, even when a non-conductive plastic injection 1001 may be disposed between the first metal housing 1012 and the FPCB 1004 and the FPCB 1004 contacts the plastic injection 1001, the first metal housing 1012 and the FPCB 1004 may operate as a capacitor together.

If the non-conductive plastic injection 1001 is replaced with metal, by coating the FPCB 1004 with a non-conductive material, the first metal housing 1012 and the FPCB 1004 may still operate together as a capacitor.

Alternatively, if the non conductive plastic injection 1001 is replaced with metal, by attaching a non-conductive adhesive tape to the metal, the first metal housing 1012 and the FPCB 1004 may still operate together as a capacitor.

According to an embodiment of the present disclosure, similar to the one example of the conductor 914 of FIG. 9, a conductive material connected to the ground part 1002 may be used as a capacitance component without the FPCB 1004. For example, steel use stainless (SUS), stainless steel (STS), or metal tape, which is connected to the ground part 1002, may serve as the conductor of a capacitor. The conductive material connected to the ground part 1002 may have a parallel plate form, a curved form, a stepped form, or a saw-tooth form.

Figure 11:
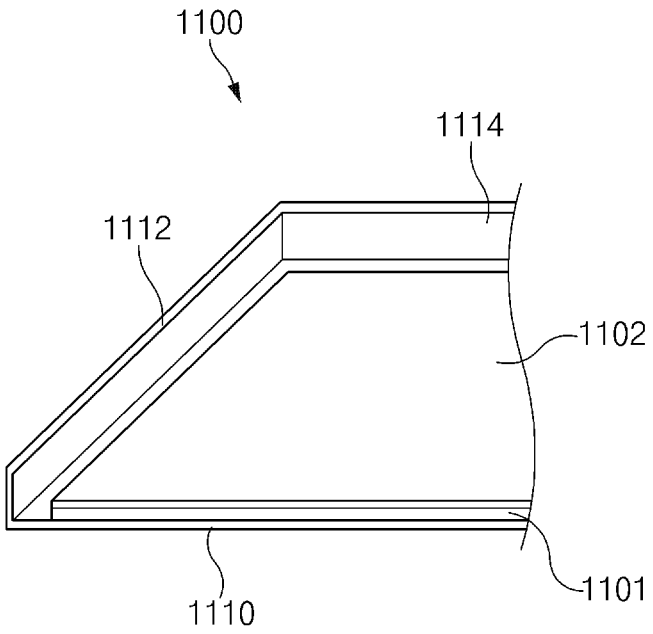
FIG. 11 illustrates an electronic device including an antenna using at least part of a metal housing and at least part of a PCB ground part as a capacitance component according to an embodiment of the present disclosure.

FIG. 11 illustrates part of an electronic device including an antenna according to an embodiment of the present disclosure.

Referring to FIG. 11, an antenna includes a first metal housing 1110, which may be a metal back housing or a metal battery cover of the electronic device 1100. Because the first metal housing 1110 and a PCB ground part 1102 are parallel to each other and have a plate form and a non-conductor 1101 is disposed between the metal housing 1110 and the PCB ground part 1102, each of the first metal housing 1110 and the PCB ground part 1102 may operate as a conductor of a capacitor. The non-conductor 1101 may be a non-conductive adhesive tape for fixing the PCB ground part 1102 to the first metal housing 1110.

Additionally, when a first side metal housing 1112 operates as a radiator, a feeding part and a ground part 1102 may be required. Because the first side metal housing 1112 is connected to the first metal housing 1110, the first side metal housing 1112 may be connected to the ground part 1102 through a capacitor including the first metal housing 1110 and including the first metal housing 1110 and the ground part 1102 as a conductor. Although not illustrated in FIG. 11, one end of the first side metal housing 1112 may be connected to a feeding part and operate as a radiator.

Although FIG. 11 illustrates that a side housing is used as a radiator, the present disclosure is not limited thereto at least part of a back housing may also be used as a radiator.

Figure 12:
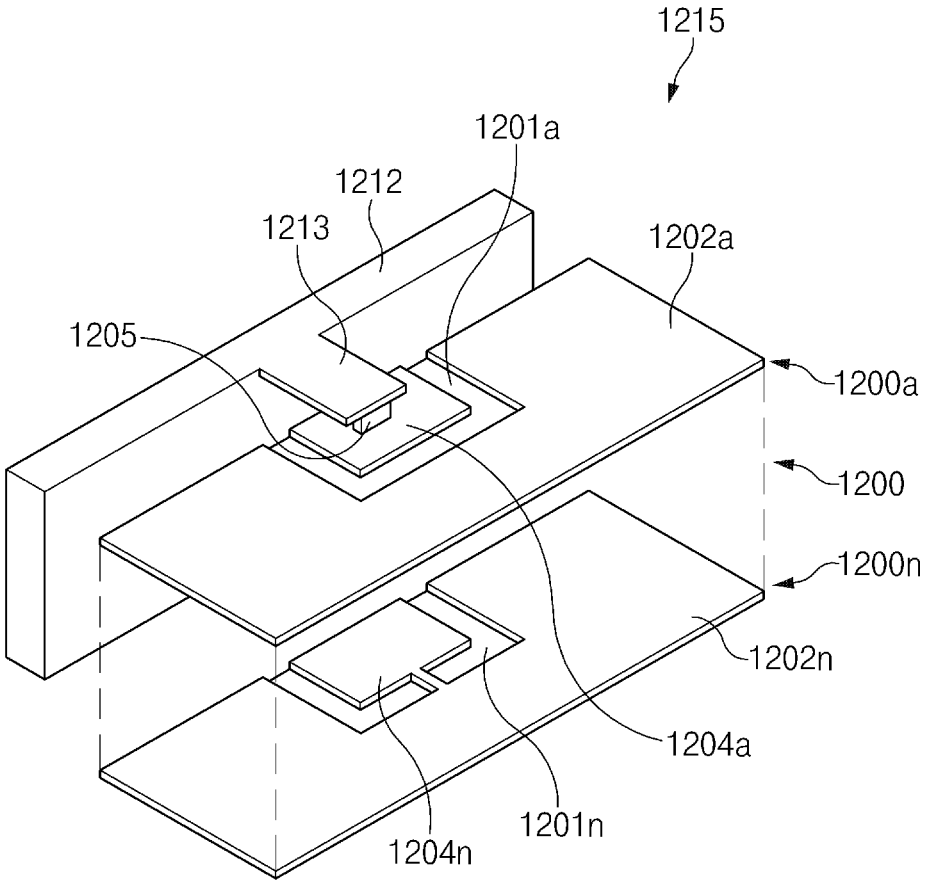
FIG. 12 illustrates an electronic device including an antenna using at least part of a first PCB layer and at least part of an nth PCB layer as a capacitance component in relation to a PCB having a plurality of PCB layers according to an embodiment of the present disclosure.

FIG. 12 illustrates an electronic device including an antenna according to an embodiment of the present disclosure.

Referring to FIG. 12, an antenna includes at least a partial area 1204*a* of a first PCB layer 1200*a* and at least a partial area 1204*n* of an nth PCB layer 1200*n* as a capacitance component in relation to a PCB 1200 having a plurality of PCB layers 1200*a* to 1200*n*.

The PCB 1200 includes the plurality of PCB layers 1200*a* to 1200*n*. Although the PCB layer 1200*n* illustrated in FIG. 12 is only the second layer, there may be a plurality of PCB layers between the PCB layer 1200*a* and the PCB layer 1200*n*.

The first PCB layer 1200*a* includes a non-ground area 1201*a*, a ground part 1202*a*, and an area 1204*a*, which operates as a conductor. When the area 1204*a* operates as a conductor, the non-ground area 1201*a* may be disposed in a corresponding area in order to solve electric shock issues. Similarly, the nth PCB layer 1200*n* may include a non-ground area 1201*n*, a ground part 1202*n*, and an area 1204*n*, which operates as a conductor.

Because at least a partial area 1204*a* of the first PCB layer 1200*a* and at least a partial area 1204*n* of the nth PCB layer 1200*n* are parallel to each other and an insulator such as glass-reinforced epoxy laminate (FR4) fills a space between the first PCB layer 1200*a* and the nth PCB layer 1200*n*, an area 1204*a* and an area 1204*n* may operate as a first conductor and a second conductor of a capacitor, respectively. Accordingly, the area 1204*a* and the area 1204*n* may block DC current as one capacitor.

The capacitor may be connected to the ground part 1202*n*. Alternatively, a non-ground area 1201*n* may be omitted from the nth PCB layer 1200*n* if the ground part 1202*n* is connected to at least a partial area 1204*n* of the nth PCB layer 1200*n*. However, the non-ground area 1201*n* may be effective in determining the area 1204*n* as the area of a conductor of a capacitor.

A connection part 1213 extends from one end of the first metal housing 1212 in the direction of the PCB 1200 and the connection part 1213 may be connected to an area 1204*a* through a fixing part 1205, such as a c-clip.

Additionally, an area 1204*n* may be connected to the ground part 1202*n*.

Accordingly, when current flows into a reflector through a feeding part, at least part of the current may flow into the ground part 1202*n* through the first metal housing 1212, the connection part 1213, the fixing part 1205, the area 1204*a*, and the area 1204*n*.

According an embodiment of the present disclosure, a value of a capacitance may be changed by changing the areas 1204*a* and 1204*n* (for example, by changing a fill cut area).

According to an embodiment of the present disclosure, an antenna includes a radiator including at least part of a metal housing, a capacitor connected to the radiator, a feeding part connected to the radiator, and a ground part connected to the capacitor.

According to an embodiment of the present disclosure, a capacitor includes at least one of a lumped element having a capacitance component. For example, the lumped element may include a fixed lumped element with the fixed capacitance value or a variable lumped element configured to change the capacitance value.

According to an embodiment of the present disclosure, a plurality of capacitors is provided and an antenna includes a controller for controlling current flow into at least one capacitor among the plurality of capacitors.

According to an embodiment of the present disclosure, a radiator includes a metal frame of an electronic device.

According to an embodiment of the present disclosure, a radiator may further include a connection part connected to a capacitor and the connection part may be disposed at a position based on an operating frequency of the antenna.

According to an embodiment of the present disclosure, a capacitor may use at least part of the metal housing as a first conductor of the capacitor and may use a conductive material connected to the ground part as a second conductor of the capacitor. For example, the conductive material may include at least one of FPCB, SUS, and tape. In this case, at least part of the metal housing may serve as a radiator and a capacitor at the same time.

According to an embodiment of the present disclosure, a capacitor uses at least part of a first layer of a PCB as a first conductor of a capacitor and uses at least part of a second layer of the PCB as a second conductor of the capacitor.

According to an embodiment of the present disclosure, a capacitor uses at least part of a PCB as a first conductor of a capacitor and uses at least part of a metal housing as a second conductor of the capacitor.

According to an embodiment of the present disclosure, an antenna includes a radiator having at least part of a metal housing, a feeding part connected to the radiator, a DC blocking member spaced from the radiator, and a ground part connected to the DC blocking member.

According to an embodiment of the present disclosure, the DC blocking member blocks the flow of DC current by using a capacitance component.

Additionally, according to an embodiment of the present disclosure, the DC blocking member blocks the flow of DC current by using a capacitance component together with at least part of the radiator disposed in correspondence to the DC blocking member.

According to an embodiment of the present disclosure, the DC blocking member includes at least one of FPCB, SUS, and tape.

According to at least one of the above-described embodiments, as an antenna to includes a capacitance component, a voltage of a DC component may be prevented from flowing to the outside through a metal housing and a voltage of an AC component may be used to operate the antenna.

The term "module" used in various embodiments of the present disclosure, for example, may mean a unit including a combination of at least one of hardware, software, and firmware. The term "module" and the terms "unit", "logic", "logical block", "component", and/or "circuit" may be interchangeably used. A "module" may be a minimum unit or part of an integrally configured component. A "module" may be a minimum unit performing at least one function or part thereof. A "module" may be implemented mechanically or electronically.

For example, a "module" according to various embodiments of the present disclosure may include at least one of an application-specific integrated circuit (ASIC) chip performing certain operations, field-programmable gate arrays (FPGAs), or a programmable-logic device, all of which are known or to be developed in the future.

According to an embodiment of the present disclosure, at least part of a device (for example, modules or functions thereof) or a method (for example, operations) according to this disclosure, for example, as in a form of a programming module, may be implemented using an instruction stored in computer-readable storage media. When at least one processor executes an instruction, it may perform a function corresponding to the instruction. The non-transitory computer-readable storage media may include a memory, for example.

The non-transitory computer-readable storage media may include hard disks, floppy disks, magnetic media (for example, magnetic tape), optical media (for example, compact disc read only memory (CD-ROM), and digital versatile disc (DVD)), magneto-optical media (for example, floptical disk), and hardware devices (for example, read only memory (ROM), random access memory (RAM), or flash memory). Additionally, a program instruction may include high-level language code executable by a computer using an interpreter in addition to machine code created by a complier. The hardware device may be configured to operate as at least one software module to perform an operation of various embodiments of the present disclosure and vice versa.

A module or a programming module according to an embodiment of the present disclosure may include at least one of the above-mentioned components, may not include some of the above-mentioned components, or may further include another component. is Operations performed by a module, a programming module, or other components according to various embodiments of the present disclosure may be executed through a sequential, parallel, repetitive or heuristic method. Additionally, some operations may be executed in a different order or may be omitted. Or, other operations may be added.

While the present disclosure has been particularly shown and described with reference to certain embodiments thereof, it will be understood by those of ordinary skill in the art that various changes in form and details may be made therein without departing from the spirit and scope of the present disclosure as defined by the following claims and their equivalents.

What is claimed is:

1. An antenna of an electronic device, the antenna comprising:

a radiator including at least part of a metal housing of the electronic device;

a capacitor connected to the radiator;

an additional capacitor;

a controller configured to control current flowing into at least one of the capacitor and the additional capacitor;

a feeding part connected to the radiator; and a ground part connected to the capacitor.

2. The antenna of claim 1, wherein the capacitor comprises at least one lumped element including a capacitance component.

3. The antenna of claim 2, wherein the lumped element comprises:

a fixed lumped element having a fixed capacitance value; or a variable lumped device having a variable capacitance value.

4. The antenna of claim 1, wherein the radiator comprises at least part of a sidewall of the electronic device, the side wall being included in the metal housing.

5. The antenna of claim 1, wherein the radiator further comprises a connection part connected to the capacitor, and wherein the connection part is disposed at a position based on an operating frequency of the antenna.

6. The antenna of claim 1, wherein the capacitor comprises:

a first layer of a printed circuit board (PCB) as a first conductor; and at least part of a second layer of the PCB as a second conductor.

7. The antenna of claim 1, wherein the capacitor comprises:

at least part of a printed circuit board (PCB) as a first conductor; and at least part of the metal housing as a second conductor.

8. The antenna of claim 1, wherein the capacitor has a fixed capacitance.

9. The antenna of claim 1, wherein the capacitor has a variable capacitance.

10. An antenna of an electronic device, the antenna comprising:

a radiator including at least part of a metal housing of the electronic device;

a feeding part connected to the radiator; and a ground part connected to a capacitor, wherein at least part of the metal housing is used as a first conductor of the capacitor and a conductive material connected to the ground part is used as a second conductor of the capacitor.

11. The antenna of claim 10, wherein the at least part of the metal housing serves as the radiator and the capacitor at the same time.

12. The antenna of claim 10, wherein at least one of a form, a length, a surface area of the conductive material, and a distance between the conductive material and the at least part of the metal housing is determined based on an operating frequency of the antennal.

13. The antenna of claim 10, wherein the conductive material is attached to a printed circuit board (PCB) including the ground part.

14. The antenna of claim 10, wherein the conductive material comprises at least one of a flexible printed circuit board (FPCB), steel use stainless (SUS), and conductive tape.

15. An antenna of an electronic device, the antenna comprising:

a radiator including at least part of a metal housing of the electronic device;

a feeding part connected to the radiator;

a direct current (DC) blocking member spaced apart from the radiator; and a ground part connected to the DC blocking member.

16. The antenna of claim 15, wherein the DC blocking member blocks a flow of a DC current by using a capacitance component.

17. The antenna of claim 15, wherein the DC blocking member blocks a flow of a DC current by using a capacitance component and at least part of the radiator disposed in correspondence to the DC blocking member.

18. The antenna of claim 15, wherein the DC blocking member comprises at least one of a flexible printed circuit board (FPCB), steel use stainless (SUS), and conductive tape.

* * * * *